US006732653B2

(12) United States Patent
Shimazu et al.

(10) Patent No.: US 6,732,653 B2
(45) Date of Patent: May 11, 2004

(54) METHOD TO REMOVE UNWANTED, UNEXPOSED, POSITIVE-WORKING, RADIATION-SENSITIVE LAYER

(75) Inventors: Ken-ichi Shimazu, Briarcliff Manor, NY (US); Kevin Ray, Fort Collins, CO (US); Melanie A. Felker, Loveland, CO (US)

(73) Assignee: Kodak Polychrome Graphics LLC, Norwalk, CT (US)

( * ) Notice: Subject to any disclaimer, the term of this patent is extended or adjusted under 35 U.S.C. 154(b) by 76 days.

(21) Appl. No.: 10/134,080

(22) Filed: Apr. 26, 2002

(65) Prior Publication Data

US 2003/0200885 A1 Oct. 30, 2003

(51) Int. Cl.[7] ..... B41N 3/00

(52) U.S. Cl. ..... 101/463.1; 101/401.1; 101/467

(58) Field of Search ..... 101/401.1, 463.1, 101/467

(56) References Cited

U.S. PATENT DOCUMENTS

| | | | | |
|---|---|---|---|---|
| 4,799,085 A | * | 1/1989 | Nagumo et al. | 355/405 |
| 5,073,791 A | * | 12/1991 | Mouri et al. | 355/27 |
| 5,345,870 A | * | 9/1994 | Bailey et al. | 101/463.1 |
| 5,699,740 A | | 12/1997 | Gelbart | 101/477 |
| 5,836,581 A | | 11/1998 | Vernackt | 271/11 |
| 6,003,442 A | | 12/1999 | Solomon et al. | 101/415.1 |
| 6,189,452 B1 | | 2/2001 | Halup et al. | 101/415.1 |
| 6,260,482 B1 | | 7/2001 | Halup et al. | 101/477 |
| 6,267,054 B1 | | 7/2001 | Lopes | 101/389.1 |
| 6,280,899 B1 | | 8/2001 | Parsons et al. | 430/270.1 |
| 6,295,929 B1 | | 10/2001 | Tice et al. | 101/477 |
| 6,352,812 B1 | | 3/2002 | Shimazu et al. | 430/273.1 |
| 6,358,669 B1 | | 3/2002 | Savariar-Hauck et al. | 43/273.1 |

FOREIGN PATENT DOCUMENTS

| | | |
|---|---|---|
| EP | 0 741 483 A1 | 11/1996 |
| EP | 0 846 638 A2 | 6/1998 |
| EP | 1 084 842 A2 | 3/2001 |
| WO | WO 96/31807 | 10/1996 |

* cited by examiner

*Primary Examiner*—Daniel J. Colilia
*Assistant Examiner*—Jill E. Culler
(74) *Attorney, Agent, or Firm*—RatnerPrestia

(57) ABSTRACT

The presence of unwanted ink-receptive sections on developed positive-working lithographic plates due to shading by plate-holding clamps during imaging, is avoided by the use of clamps that are substantially transparent to the imaging radiation. In the case where the plate precursors can be imaged by heat, the presence of unwanted unexposed sections can also be avoided by selectively heating those sections shaded by the clamps, while avoiding heating the image section of the plate.

9 Claims, No Drawings

METHOD TO REMOVE UNWANTED, UNEXPOSED, POSITIVE-WORKING, RADIATION-SENSITIVE LAYER

FIELD OF THE INVENTION

The invention relates to positive-working lithographic printing plates. More particularly, it relates to methods for avoiding the need to remove unwanted, unexposed areas left on the finished plates due to shading of sections of the plate precursors by platesetter clamps or other plate-holding elements.

BACKGROUND OF THE INVENTION

In lithographic printing, ink-receptive regions, known as image areas, are generated on a hydrophilic surface. When the surface is moistened with water and ink is applied, the hydrophilic regions retain the water and repel the ink, and the ink-receptive regions accept the ink and repel the water. The ink is then transferred to the surface of a material upon which the image is to be reproduced. Typically, in a method known as "offset", this is done indirectly by first transferring the ink to an intermediate blanket, which in turn transfers the ink to the surface of the material upon which the image is to be reproduced.

A class of imageable elements called printing plate precursors, useful for preparing lithographic printing plates, comprises a layer applied over the surface of a hydrophilic substrate. The layer includes one or more radiation-sensitive components, which may be dispersed in a suitable binder. Alternatively, or in addition, the binder itself may be radiation-sensitive. The layer is commonly applied as a coating, using a solvent.

If after exposure to radiation the exposed regions of the coating are removed in the developing process, revealing the underlying hydrophilic surface of the substrate, the plate precursor is referred to as "positive-working". Conversely, if the unexposed regions are removed by the developing process and the exposed regions remain, the plate precursor is called "negative-working".

In both cases, the regions of the radiation-sensitive layer (i.e., the image areas) that remain are ink-receptive, and the regions of the hydrophilic surface revealed by the developing process accept water, typically a fountain solution, and repel ink.

An alternative way of achieving the same result is to begin with a hydrophilic surface upon which, after imagewise exposure and developing, an ink-receptive pattern representing the image is obtained. If the unexposed areas become ink receptive, the plate precursor is "positive-working", while if the exposed areas become ink receptive, it is "negative-working".

Recent developments in the field of printing plate precursors deal with radiation-sensitive compositions that can be imagewise exposed by means of lasers or laser diodes. This type of exposure, known as digital imaging, does not require films as intermediate information carriers since lasers can be controlled by computers.

High-performance lasers or laser diodes that are typically used in commercially available exposure devices (known as platesetters) emit light in the wavelength ranges of either 800 to 850 nm or 1060 to 1120 nm. Therefore printing plate precursors, or initiator systems contained therein, which are to be imagewise exposed by means of such platesetters, have to be sensitive in the near infrared range. They are not however typically very sensitive to visible light. Such printing plate precursors can therefore basically be handled under daylight conditions, which significantly facilitates their production and processing.

Thermally imageable elements useful as lithographic printing plate precursors, exposable by infrared lasers or laser diodes as described above, are becoming increasingly important in the printing industry. After imagewise thermal exposure, the rate of removal of the exposed regions by a developer in positive-working elements is greater than the rate of removal of the unexposed regions, so that the exposed regions are removed by the developer to form an image. Such systems are disclosed in, for example, Parsons, WO 97/39894 and U.S. Pat. No. 6,280,899; Nagasaka, EP 0 823 327; Miyake, EP 0 909 627; West, WO 98/42507 and U.S. Pat. No. 6,090,532; and Nguyen, WO 99111458 and U.S. Pat. No. 6,060,217.

Printing plate precursors are also in use which are imageable by ultraviolet radiation, as are types that are imageable by visible radiation.

Imaging of digital, thermally imageable precursors is typically done using platesetters, where the plate precursor is mounted either i). on a rotatable drum (external drum), typically using clamps, or ii). in a drum (internal device), in which case the plate precursors are held in place with compressed air or with clamps, which may be magnetic.

When a positive-working lithographic printing plate precursor is imaged on a platesetter employing clamps, the clamping device prevents the successful exposure of the coating immediately under the clamp. After development, this unexposed area of coating accepts ink. Unless this section of coating is removed manually (a time-consuming process), it will cause an unwanted image on the press. The problem is particularly troublesome for web presses, where ink is wasted and unwanted inked image areas can transfer to the back of paper stocks.

Rather than using clamps, some platesetters employ suction cups and powerful vacuums. On mounting a plate precursor on such a platesetter, however, at least one edge of the plate precursor is typically inserted into a crevice in the drum, where it is shaded from the imaging radiation. In such systems, the presence of unwanted, remaining image areas is therefore still not avoided. Thus there remains a need for ways of avoiding the time-consuming step of removing such unwanted image areas after plate development.

SUMMARY OF THE INVENTION

This need is addressed by the present invention. In one aspect, the invention is a method for eliminating an unwanted ink-receptive section of a printing plate precursor present after treatment of an unwanted unexposed section with a developer, the unwanted ink-receptive section being shaded by a plate-holding element from exposing radiation during an imagewise exposure of the plate precursor and therefore remaining unexposed to the exposing radiation following the imagewise exposure, the section comprising a heat-sensitive layer, the method comprising heating the unwanted unexposed section prior to developing the plate precursor to a temperature such that following development the section is hydrophilic.

In another aspect, the invention is a method for preparing a printing plate comprising the steps of (a) providing a positive-working printing plate precursor comprising a radiation-sensitive region on a front surface of the precursor, the radiation-sensitive region comprising a heat-sensitive layer;

(b) mounting the precursor on an exposure device with a plate-holding element wherein the element overlaps a section of the radiation-sensitive region of the precursor;

(c) imagewise exposing the radiation-sensitive region of the precursor to exposing radiation, the radiation selected to render the heat-sensitive layer exposed to the radiation soluble or dispersible in a developer;

(d) heating the section of the radiation-sensitive region overlapped by the element in a manner sufficient to render the overlapped section soluble or dispersible in the developer;

(e) removing the precursor from the exposure device; and (f) developing the precursor in the developer to form the plate.

In yet another aspect, the invention is a method of avoiding the formation of an unwanted unexposed section in a positive-working printing plate precursor due to shading by a plate-holding element from exposing radiation during an imagewise exposure of the precursor and therefore remaining unexposed to the exposing radiation following the imagewise exposure, the method comprising employing a plate-holding element to secure the precursor during imagewise exposure, wherein the plate-holding element is substantially transparent to the exposing radiation.

In still another aspect, the invention is a method for preventing the generation of ink receptivity in an unwanted unexposed section of a developed plate prepared from a positive-working printing plate precursor, the section being shaded by a plate-holding element from exposing radiation during an imagewise exposure of the precursor and therefore remaining unexposed to the exposing radiation following the imagewise exposure, the section comprising a heat-sensitive layer capable of generating ink receptivity in the developed plate upon treatment of the precursor with a developer, the method comprising heating the section prior to the treatment, the heating selected to render the heat-sensitive layer of the section incapable of generating ink receptivity in the developed plate upon treatment of the precursor with the developer.

In a still further aspect, the invention is a method for preparing a printing plate comprising the steps of (a) providing a positive-working printing plate precursor comprising a radiation-sensitive region on a front surface of the precursor, the radiation-sensitive region comprising a heat-sensitive layer capable, upon treatment with a developer, of generating ink receptivity in a developed plate prepared from the precursor;

(b) mounting the precursor on an exposure device with a plate-holding element wherein the element overlaps a section of the radiation-sensitive region of the precursor;

(c) imagewise exposing the radiation-sensitive region of the precursor to exposing radiation, the radiation selected to render the heat-sensitive layer exposed to the radiation incapable of generating ink receptivity in the developed plate upon treatment of the precursor with the developer;

(d) heating the section of the radiation-sensitive region overlapped by the element, the heating selected to render the heat-sensitive layer of the section incapable of generating ink receptivity in the developed plate upon treatment of the precursor with the developer;

(e) removing the precursor from the exposure device; and (f) developing the precursor in the developer to form the plate.

DETAILED DESCRIPTION OF THE INVENTION

One process of producing a printing plate from a positive-working printing plate precursor involves providing a precursor, imagewise exposing it to radiation designed to make exposed parts of the radiation-sensitive layer soluble or dispersible in a developer, and using the developer to produce a finished plate. In the present invention, unwanted unexposed areas can also be rendered soluble or dispersible through selective heating, or through avoiding their formation altogether via the use of plate-holding elements that are substantially transparent to the exposing radiation. Each of these elements will be discussed in detail below.

Printing Plate Precursors

A variety of printing plate precursors is available commercially. Depending on the type of precursor, the imaging radiation is commonly visible radiation, ultraviolet radiation, or infrared radiation, with precursors of this last type also being called "thermal" plate precursors.

Thermal plate precursors are characterized by the presence of a "photothermal conversion material" which absorbs the imaging radiation and converts it to heat, causing imaged areas of the precursor to become soluble or dispersible in the developer. Photothermal conversion materials may absorb ultraviolet, visible, and/or infrared radiation to perform this function. Such materials are disclosed in numerous patents and patent applications, including Nagasaka, EP 0,823,327; Van Damme, EP 0,908,397; DeBoer, U.S. Pat. No. 4,973,572; Jandrue, U.S. Pat. No. 5,244,771; and Chapman, U.S. Pat. No. 5,401,618. Examples of useful absorbing dyes include ADS-830 WS and ADS-1064 (both available from American Dye Source, Montreal, Canada), EC2117 (available from FEW, Wolfen, Germany), CYASORB® IR 99 and CYASORB® IR 165 (both available from Glendale Protective Technology), EPOLITE® IV-62B and EPOLITE® III-178 (both available from the Epoline), PINA-780 (available from the Allied Signal Corporation), SpectralR 830A and SpectralR 840A (both available from Spectra Colors).

Plate precursors useful for this invention include 1-layer thermal plate precursors, which are a preferred embodiment. These are commercially available under such trade names as ELECTRA® and ELECTRA® EXCEL, available from Kodak Polychrome Graphics. Single layer thermal plate precursors are described by Parsons, U.S. Pat. No. 6,280,899, incorporated herein by reference.

Also preferred are 2-layer systems in which the photothermal conversion material resides in the bottom layer. Such a system is commercially available under the trade name SWORD™, available from Kodak Polychrome Graphics. Systems of this sort are described by Shimazu in U.S. Pat. No. 6,352,812 and by Savariar-Hauck in U.S. Pat. No. 6,358,669, both incorporated herein by reference, and comprise a hydrophilic substrate, an underlayer on the substrate which comprises a developer-soluble or developer-dispersible polymer and a photothermal conversion material, and a top layer that is not soluble or dispersible in the developer.

Also useful for this invention are 2-layer thermal plate precursors in which the photothermal conversion material resides in the top layer. These are described for instance by Van Damme, EP-O-864-420-A1 and Verschueren, EP-O-940-266-A1.

Three-layer thermal plate precursors are also useful, such as are described in U.S. application Ser. No. 09/999,587, incorporated herein by reference. Such systems comprise a hydrophilic substrate, an underlayer on the substrate which comprises a developer-soluble or developer-dispersible polymer and a photothermal conversion material, a barrier layer to prevent the photothermal conversion material from migrating, comprising a developer-soluble or developer-dispersible polymer, and a top layer comprising a polymer that is not soluble or dispersible in the developer.

Also useful for this invention are 2-layer visible light sensitive plate precursors, of which a number of models are well known and commercially available.

Another type of printing plate precursor suitable for use with this invention is described by Watkiss in U.S. Pat. No. 4,859,290. In such a system, unexposed silver halide diffuses to the surface of an aluminum substrate bearing nuclei capable of reducing the silver halide to metallic silver, which forms the basis for an oleophilic region on the developed plate. In this system, the silver halide in exposed areas is incapable of such diffusion and thus does not render the substrate oleophilic. According to the present invention, such immobilization of the silver can also be achieved by heating unexposed sections of the precursor.

Although the above-mentioned systems are the most common, the invention is applicable to radiation-sensitive positive-working systems irrespective of the number of layers employed in the plate precursor, and irrespective of whether the hydrophilic areas of the finished plate are formed by removal of hydrophobic material or by preventing the conversion of hydrophilic areas to ink-receptive ones. In general, these precursors are all employed in their routine manner of use, except where explicitly deviated from for the purposes of the invention.

Imagewise Exposure

Imaging of the precursors can be performed with commercially available exposure devices, also known as platesetters. For thermal systems, for example, one can use a Creo TRENDSETTER® 3244, supplied by CreoScitex Corporation, Burnaby, Canada; a Platerite 8000, supplied by Screen, Rolling Meadows, Ill.; or a Gerber Crescent 42T, supplied by the Gerber Corporation. Many others are available, and any of these is applicable. The platesetter is used according to normal procedures for the unit, except where explicitly deviated from for the purposes of the invention. Typical exposure conditions for thermal plate precursors are given in the Examples.

For platesetters using visible light, commercial units include Platerite from Screen, Rolling Meadows, Ill.; LaserStar from Krause, Branford, Conn.; Antares 1600 from Cymbolic Sciences, Blaine, Wash.; Galileo from Agfa, Wilmington, Mass.; and Lithosetter III from Barco Graphics, Vandalia, Ohio.

Transparent Plate-Holding Elements

The transparent plate-holding elements are constructed of materials that are substantially transparent to the imaging radiation; such materials are well known in the art. Suitable materials of construction of the plate-holding elements include, but are not limited to, most grades of clear glass, polymethyl methacrylate, polycarbonate, polyvinyl chloride, glass fiber-reinforced polyester, magnesium fluoride, barium fluoride, calcium fluoride, potassium bromide, and lithium fluoride. Also useful are thallium halides, especially mixtures such as 1) about 40 wt. % thallium bromide and about 60 wt. % thallium iodide, and 2) about 30 wt. % thallium bromide and about 70 wt. % thallium chloride. Also useful are chalcogenide glasses, polycrystalline zinc selenide, zinc sulfide, and lanthanide sulfides. Fused silica (isotropic silicon dioxide) is also useful.

Selective Heating

The printing plate precursors of this invention are positive working, meaning that the radiation-sensitive composition is ultimately removed from areas exposed to the imaging radiation. This requires that the composition in those areas be converted to a form that is more easily soluble or dispersible in the developer than it is in the unexposed areas. In the case of infrared-sensitive plate precursors, heating of the exposed areas causes this change, and is usually performed by the action of an infrared laser during the imaging process. If the plate-holding elements are largely opaque to the infrared radiation, areas of the precursor under them do not get heated and therefore cannot normally be removed during developing. However, according to this invention these areas are heated by other means, thereby rendering these areas also removable by the developer.

The time and temperature of heating required for the practice of this invention vary with the sensitivity of the plate precursor to thermal energy, with the time required being a roughly inverse function of the temperature applied. Such conditions are easily determined for a given type of plate precursor.

Several different methods can be used to perform the heating step. Examples include, but are not limited to, the following methods.

Heating may be performed by contact of the precursor with a hot bar of such a size and shape as to contact the shaded areas of the precursor, without contacting any areas within the imaged region. The bar may be incorporated in a frame or other holding device separate from the platesetter, or may be incorporated into the platesetter in the form of the plate-holding element itself.

The bar may be made of any of a number of materials, providing that the material be thermally stable under the conditions of use and resistant to attack by any chemical components, e.g. from the plate precursor, with which it might come into contact.

Preferred are materials that have a high heat capacity and are highly thermally conductive, for example stainless steel and copper.

Advantageously, the bar may be heated internally by electrical resistance.

Heating may also be performed by the use of a strip infrared heater, such as Model FB or FBG from Casso-Solar Corporation, Pomona, N.Y.; Series TRH or series CV infrared heaters from Infrared Heaters, Clearwater, Fla.; and ProDryer or Ram-Dryer infrared ovens from IR Systems, Jupiter, Fla.

Heating may also be performed by using a stream of hot air, directed in such a way as to heat the shaded regions of the precursor but not the image area.

Heating can be performed before the plate precursor is put on the platesetter, if it is known in advance what areas will be shaded from the imaging radiation by the plate-holding elements. Advantageously, such pre-treatment may be performed at the time of precursor manufacture, eliminating the need to take additional steps at the time of use.

Heating can also be performed on the platesetter itself, using plate-holding elements that are heated by some means, an example being electrical resistance heating. The use of this approach allows the treatment to be performed while the precursor is on the platesetter for imaging, so that the heat treatment and the imagewise exposure are substantially simultaneous.

Alternatively, heating can be performed after imagewise exposure, on a device constructed for the purpose. In this mode of practice, existing commercial platesetters can be used without modification, while still allowing expeditious removal of the unwanted unexposed areas.

It is also possible to perform heating even after the plate precursor has been fully developed, which requires however that the developing step be subsequently repeated.

Developing the Plate Precursors

Developing of the exposed precursors to form the finished plates is performed with commercially available developers designed for the type of plate precursor being used. Many types are available, and their selection and use is well known in the art. Essentially any developer normally suitable for use with a particular plate precursor is suitable for use in the practice of this invention. In general, normal procedures are used unless specific mention is made to the contrary.

EXAMPLES

Glossary

956 Developer (solvent based developer, Kodak Polychrome Graphics, Norwalk, Conn.)

GOLDSTAR™ developer (14% aqueous sodium metasilicate pentahydrate developer, Kodak Polychrome Graphics, Norwalk, Conn.)

GREENSTAR™ developer (7% aqueous sodium metasilicate pentahydrate developer, Kodak Polychrome Graphics, Norwalk, Conn.)

L5000 developer (thiosulfate-containing developer, Agfa-Gaevert, Mortsel, Belgium)

L5300 finisher (Agfa-Gaevert, Mortsel, Belgium)

Comparative Example 1

An ELECTRA® 830W printing plate precursor (positive-working, thermally sensitive, as supplied by Kodak Polychrome Graphics, Norwalk, Conn.), size 460×660×0.3 mm, was exposed on a Creo TRENDSETTER® 3244 (as supplied by CreoScitex Corporation, Burnaby, Canada), under the following conditions: 8 W, drum speed 86 rpm, with an imaging energy density of 200 $mJcm^{-2}$, using a solid internal image pattern (100% exposure, plot 12). The plate precursor was then immersed in GOLDSTAR™ developer using a MERCURY™ Mk V processor (available from Kodak Polychrome Graphics, Norwalk, Conn.), developer temperature 25° C., throughput speed 750 mm/minute. Examination of the developed plate indicated unwanted, retained coating areas around the leading and trailing edges of the plate, where the clamping device of the platesetter covered the plate surface, thus blocking exposure to the infrared laser. As used herein, "leading edge" means the first edge to be transported into the platesetter. The "trailing edge" was last in.

On a press, such unwanted coating would produce a printed image. In order to eliminate such undesired coating, the plate would require manual treatment with a deletion method, adding manual steps to an otherwise completely automated process.

Comparative Example 2

A SWORD™ printing plate precursor (positive-working, thermally sensitive, as supplied by Kodak Polychrome Graphics, Norwalk, Conn.), size 460×660×0.3 mm, was exposed on a Creo TRENDSETTER® 3244 under the following conditions:13.5 W, drum speed 250 rpm, with an imaging energy density of 120 $mJcm^{-2}$, using a solid internal image pattern (100% exposure, plot 12). The plate precursor was then immersed in 956 developer using a model 85 NS processor (available from Kodak Polychrome Graphics, Norwalk, Conn.). Examination of the developed plate indicated unwanted, retained coating areas around the leading and trailing edges of the plate, where the clamping device of the platesetter covered the plate surface, thus blocking exposure to the infrared laser.

Example 1

Simulation of Edge Exposure in a Heating Apparatus After Infrared Exposure

An ELECTRA® 830W printing plate precursor, size 460×660×0.3 mm, was exposed as described in Comparative Example 1. Just prior to developing, the plate precursor was heated for 38 seconds along the trailing and leading edges with a strip infrared heater, during which time the plate precursor came to a temperature of 235° C. The plate precursor was then developed as in Comparative Example 1. On examination of the developed plate, no unwanted, retained coating could be seen. Other successful results were achieved with heating times from 31 to 48 seconds.

Example 2

Simulation of Edge Exposure in a Heating Apparatus After Infrared Exposure

A SWORD™ printing plate precursor, size 460×660×0.3 mm, was exposed as described in Comparative Example 2. Just prior to developing, the plate precursor was heated for 60 seconds along the trailing and leading edges with a strip infrared heater, during which time the plate precursor came to a temperature of 235° C. The plate precursor was then developed as in Comparative Example 1. On examination of the developed plate, no unwanted, retained coating could be seen.

Example 3

Simulation of Heated Platesetter Clamps

An ELECTRA® 830W printing plate precursor, size 460×660×0.3 mm, was exposed and developed as described in Comparative Example 1. A 30×8×0.5 cm bar of stainless steel, designed to simulate a heated clamp, was heated in an oven until it reached 240° C. The hot stainless steel bar was placed upon the unwanted remaining coating area of the printing plate. After 30 seconds it was removed and the plate was re-developed. On examination of the developed plate, no unwanted, retained coating could be seen in the plate areas where the hot steel had been placed.

Example 4

Simulation of Edge Exposure Completed at Factory Prior to Plate Precursor Shipping An ELECTRA® 830W printing plate precursor, size 460×660×0.3 mm, was heated for 38 seconds along the trailing and leading edges with a strip infrared heater, during which time the plate precursor came to a temperature of 235° C. The plate precursor was then exposed on a Creo TRENDSETTER® 3244 under the following conditions: 8 W, drum speed 86 rpm, with an imaging energy density of 200 $mJcm^{-2}$, using a solid internal image pattern (100% exposure, plot 12). The plate precursor was then immersed in GOLDSTAR™ developer using a MERCURY™ Mk V processor (developer temperature 25° C., throughput speed 750 mm/minute). On examination of the developed plate, no unwanted, retained coating could be seen.

Example 5

Simulation of Edge Exposure in a Heating Apparatus After Infrared Exposure

An ELECTRA® 830W printing plate precursor, size 460×660×0.3 mm, was exposed as described in Comparative Example 1. Just prior to developing, the plate precursor was heated along the trailing and leading edges with a hot gun (model number HG-301A as supplied by Master Appliance Corporation, Racine, Wis.). The hot gun can produce 260° C. heated air, and this was played over the plate precursor edges for 30 seconds. The plate precursor was then developed as in Comparative Example 1. On examination of the developed plate, no unwanted, retained coating could be seen.

Comparative Example 3

A THERMOSTAR® P970 printing plate precursor (positive-working, thermally sensitive, as supplied by Agfa-Gevaert, Mortsel, Belgium), size 460×660×0.3 mm, was exposed on a Creo TRENDSETTER® 3244 under the following conditions: 8 W, drum speed 86 rpm, with an imaging energy density of 200 $mJcm^{-2}$, using a solid internal image pattern (100% exposure, plot 12). The plate precursor was then immersed in GOLDSTAR™ developer using a MERCURY™ Mk V processor (developer temperature 25° C., throughput speed 750 mm/minute). Examination of the developed plate indicated unwanted, retained coating areas around the leading and trailing edges of the plate, where the clamping device of the platesetter covered the plate surface, thus blocking exposure to the infrared laser.

Example 5

Simulation of Edge Exposure in a Heating Apparatus After Infrared Exposure

A THERMOSTAR® P970 printing plate precursor, size 460×660×0.3 mm, was exposed as described in Comparative Example 3. Just prior to developing, the plate precursor was heated for 38 seconds along the trailing and leading edges with a strip infrared heater, during which time the plate precursor came to a temperature of 235° C. The plate precursor was then developed as in Comparative Example 3. On examination of the developed plate, no unwanted, retained coating could be seen.

Comparative Example 4

A BRILLIA® LH PI printing plate precursor (positive-working, thermally sensitive, as supplied by Fuji Photo Film Company, Limited, Kanagawa-ken, Japan), size 460×660×0.3 mm, was exposed on a Creo TRENDSETTER® 3244 under the following conditions: 8 W, drum speed 86 rpm, with an imaging energy density of 200 $mJcm^{-2}$, using a solid internal image pattern (100% exposure, plot 12). The plate precursor was then immersed in Greenstar developer at 25° C. and rubbed gently with a cotton wool pad for 60 seconds. It was then rinsed in running water and dried. Examination of the developed plate indicated unwanted, retained coating areas around the leading and trailing edges of the plate, where the clamping device of the platesetter covered the plate surface, thus blocking exposure to the infrared laser.

Example 6

Simulation of Edge Exposure in a Heating Apparatus After Infrared Exposure

A BRILLIA® LH PI printing plate precursor, size 460×660×0.3 mm, was exposed as described in Comparative Example 4. Just prior to developing, the plate precursor was heated for 38 seconds along the trailing and leading edges with a strip infrared heater, during which time the plate precursor came to a temperature of 235° C. The plate precursor was then developed as in Comparative Example 4. On examination of the developed plate, no unwanted, retained coating could be seen.

Comparative Example 5

Visible Light Imaging

A Lithostar Ultra-V printing plate precursor (positive working, 400 to 410 nm sensitive, as supplied by Agfa-Gevaert, Mortsel, Belgium), size 460×660×0.3 mm, is exposed on an Agfa Galileo VS platesetter with an imaging energy density of 26 $mJ/m^2$, using a solid internal imaging test pattern (i.e., 100% exposure). The plate precursor is then processed in an LP150 processor (supplied by Agfa-Gaevert) by immersion in L5000, and then finished with L5300 finisher, under these conditions: processor speed=2.5 cm/second; developer temperature=22° C., wash temperature=40° C., rinse temperature=48° C., finisher temperature=48° C., developer replenishment rate=150 $ml/M^2$, finisher replenishment rate=150 $ml/m^2$. Examination of the developed plate indicates unwanted, retained coating areas where the clamping/holding device of the platesetter covered the plate surface, thus blocking exposure to the violet radiation.

Example 7

Simulation of Edge Exposure in a Heating Apparatus After Visible Light Exposure

A Lithostar Ultra-V printing plate precursor, size 460×660×0.3 mm, is exposed as described above. Just prior to processing, the plate precursor is heated for 60 seconds with an infrared heater in the areas of the plate where the clamping/holding device of the platesetter has covered the plate surface, during which time the plate precursor comes to a temperature of about 235° C. The plate precursor is then developed as above. On examination of the developed plate, no unwanted, retained coating can be seen.

Having described the invention, we now claim the following and their equivalents.

What is claimed is:

1. A method for eliminating an unwanted ink-receptive section of a printing plate precursor present after treatment with a developer, said plate precursor comprising a heat-sensitive layer capable, upon treatment with a developer following exposure to imaging radiation, of generating ink receptivity in a developed plate prepared from said precursor, said unwanted ink-receptive section being a shaded section of said heat sensitive layer shaded by a plate-holding element from exposing radiation during an imagewise exposure of said plate precursor and therefore remaining unexposed to said exposing radiation following said imagewise exposure, the method comprising heating said shaded section of said plate prior to developing said plate precursor to a temperature such that following development said shaded section is hydrophilic wherein said heating occurs during said imagewise exposure.

2. The method according to claim 1 wherein said plate precursor is a positive working plate precursor and wherein said heating of said shaded section renders said shaded section hydrophilic by rendering said heat-sensitive layer of said shaded section soluble or dispersible in said developer.

3. The method of claim 1 wherein said unwanted shaded section comprises a photothermal conversion material.

4. A method for eliminating an unwanted ink-receptive section of a printing plate precursor present after treatment with a developer, said plate precursor comprising a heat-sensitive layer capable, upon treatment with a developer following exposure to imaging radiation, of generating ink receptivity in a developed plate prepared from said precursor, said unwanted ink-receptive section being a shaded section of said heat sensitive layer shaded by a plate-holding element from exposing radiation during an imagewise exposure of said plate precursor and therefore remaining unexposed to said exposing radiation following said imagewise exposure, the method comprising heating said shaded section of said plate prior to developing said plate precursor to a temperature such that following development said shaded section is hydrophilic, wherein said plate-holding element is also a heating element and the step of heating said section shaded by said plate-holding element is performed with said heating element.

5. A method for preparing a printing plate comprising the steps of:

(a) providing a positive-working printing plate precursor comprising a radiation-sensitive region on a front surface of said precursor, said radiation-sensitive region comprising a heat-sensitive layer capable, upon treatment with a developer, of generating ink receptivity in a developed plate prepared from said precursor;

(b) mounting said precursor on an exposure device with a plate-holding element wherein said element overlaps a section of said radiation-sensitive region of said precursor and wherein said element is also a heating element;

(c) imagewise exposing said radiation-sensitive region of said precursor to exposing radiation, said radiation selected to render said heat-sensitive layer exposed to said radiation incapable of generating ink receptivity in said developed plate upon treatment of said precursor with said developer;

(d) using said heating element to heat said section of said radiation-sensitive region overlapped by said element, said heating selected to render said heat-sensitive layer of said section incapable of generating ink receptivity in said developed plate upon treatment of said precursor with said developer;

(e) removing said precursor from said exposure device; and (f) developing said precursor in said developer to form said plate.

6. The method of claim 5 wherein step c) is performed simultaneously with step (d).

7. The method of claim 5 wherein step (c) is performed after step (d).

8. A method for preparing a printing plate comprising the steps of:

(a) providing a positive-working printing plate precursor comprising a thermally imageable region on a front surface of said precursor, said thermally imageable region comprising a heat-sensitive layer;

(b) determining an area on said thermally imageable region that will be undesirably shaded during imagewise exposure;

(c) heating said undesirably shaded area of said thermally imageable region, said heating selected to render said undesirably shaded area soluble or dispersible in said developer;

(d) subsequently mounting said precursor on an exposure device with a plate-holding element wherein said element overlaps said heated area of said thermally imageable region of said precursor;

(e) imagewise exposing said thermally imageable region of said precursor to imaging radiation, said radiation selected to render said heat-sensitive layer exposed to said radiation soluble or dispersible in a developer;

(f) removing said precursor from said exposure device; and (g) developing said precursor in said developer to form said plate.

9. A method for preparing a printing plate comprising the steps of:

(a) providing a positive-working printing plate precursor comprising a thermally imageable region on a front surface of said precursor, said thermally imageable region comprising a heat-sensitive layer;

(b) mounting said precursor on an exposure device with a plate-holding element wherein said element overlaps said heated area of said thermally imageable region of said precursor;

(c) imagewise exposing said thermally imageable region of said precursor to imaging radiation, said radiation selected to render said heat-sensitive layer exposed to said radiation soluble or dispersible in a developer;

(d) removing said precursor from said exposure device;

(e) determining an area on said thermally imageable region that was undesirably shaded during the imagewise exposure;

(f) heating said undesirably shaded area of said thermally imageable region, said heating selected to render said undesirably shaded area soluble or dispersible in said developer; and (g) developing said precursor in said developer to form said plate.

* * * * *